US011258149B2

(12) United States Patent
Franzi et al.

(10) Patent No.: US 11,258,149 B2
(45) Date of Patent: Feb. 22, 2022

(54) NON-RECIPROCAL MICROWAVE WINDOW

(71) Applicant: The Board of Trustees of the Leland Stanford Junior University, Stanford, CA (US)

(72) Inventors: Matthew A. Franzi, Burlingame, CA (US); Sami G. Tantawi, Stanford, CA (US)

(73) Assignee: The Board of Trustees of the Leland Stanford Junior University, Stanford, CA (US)

( * ) Notice: Subject to any disclaimer, the term of this patent is extended or adjusted under 35 U.S.C. 154(b) by 0 days.

(21) Appl. No.: 16/965,189

(22) PCT Filed: Feb. 14, 2019

(86) PCT No.: PCT/US2019/018098

§ 371 (c)(1),
(2) Date: Jul. 27, 2020

(87) PCT Pub. No.: WO2019/161122

PCT Pub. Date: Aug. 22, 2019

(65) Prior Publication Data

US 2021/0167475 A1 Jun. 3, 2021

Related U.S. Application Data

(60) Provisional application No. 62/630,812, filed on Feb. 14, 2018.

(51) Int. Cl.

| | |
|---|---|
| ***H01P 1/19*** | (2006.01) |
| ***H01P 1/397*** | (2006.01) |
| ***H01P 1/17*** | (2006.01) |

(52) U.S. Cl.
CPC ..... *H01P 1/174* (2013.01)

(58) Field of Classification Search
CPC ..... H01P 1/19; H01P 1/397
See application file for complete search history.

(56) References Cited

U.S. PATENT DOCUMENTS

| | | | | |
|---|---|---|---|---|
| 3,187,274 A | | 6/1965 | Owen | |
| 3,246,261 A | | 4/1966 | Stelzer | |
| 4,389,594 A | * | 6/1983 | Conciauro | H01J 23/20 315/39.55 |
| 4,467,292 A | * | 8/1984 | Ajioka | H01P 1/19 333/158 |
| 4,884,045 A | * | 11/1989 | Alverson | H01P 1/19 333/158 |
| 4,916,414 A | * | 4/1990 | Ranghelli | H01P 1/397 333/1.1 |
| 9,419,322 B2 | | 8/2016 | Tantawi | |

FOREIGN PATENT DOCUMENTS

| | | |
|---|---|---|
| GB | 859604 | 1/1961 |
| GB | 1039527 | 8/1966 |

* cited by examiner

*Primary Examiner* — Dean O Takaoka
(74) *Attorney, Agent, or Firm* — Lumen Patent Firm

(57) ABSTRACT

A non-reciprocal microwave network is provided that includes an in-line ferromagnetic element [1010] with adjoining polarizing adapters [1002, 1004, 1006, 1008] to achieve directivity via a multi-mode interaction at or near the ferrite to act as new class of 4-port circulator or 2-port isolator, with standard waveguide inputs for assembly in larger networks.

14 Claims, 19 Drawing Sheets

Fig. 1A
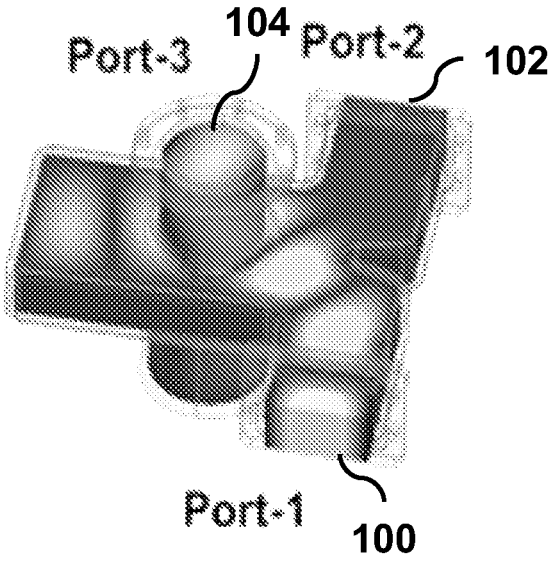
Fig. 1B
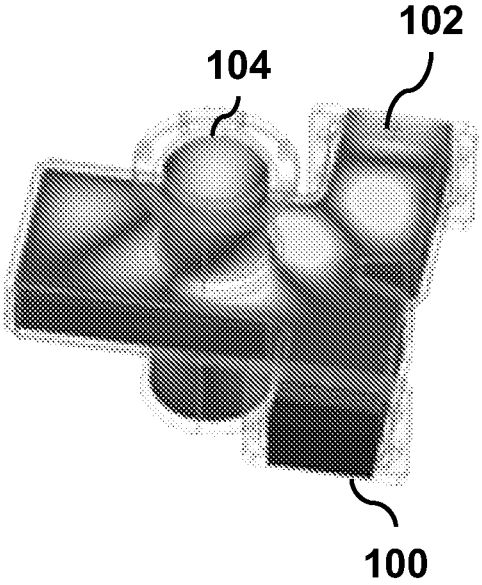
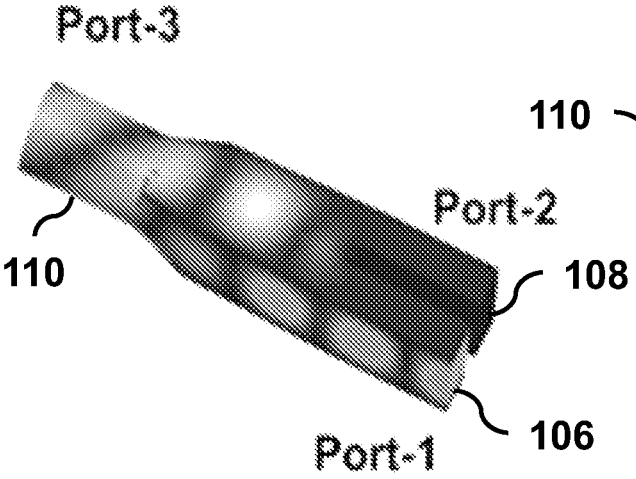
Fig. 1C
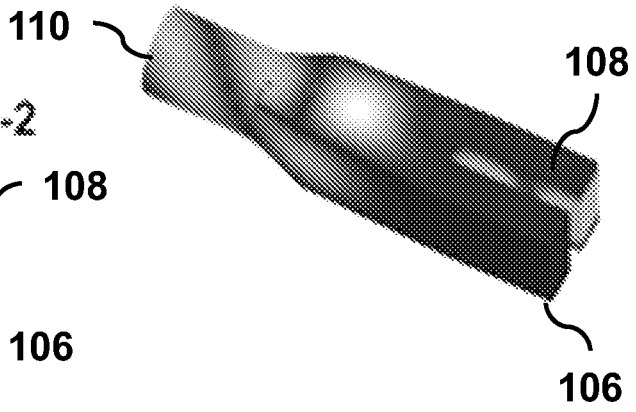
Fig. 1D

*Fig. 2A*
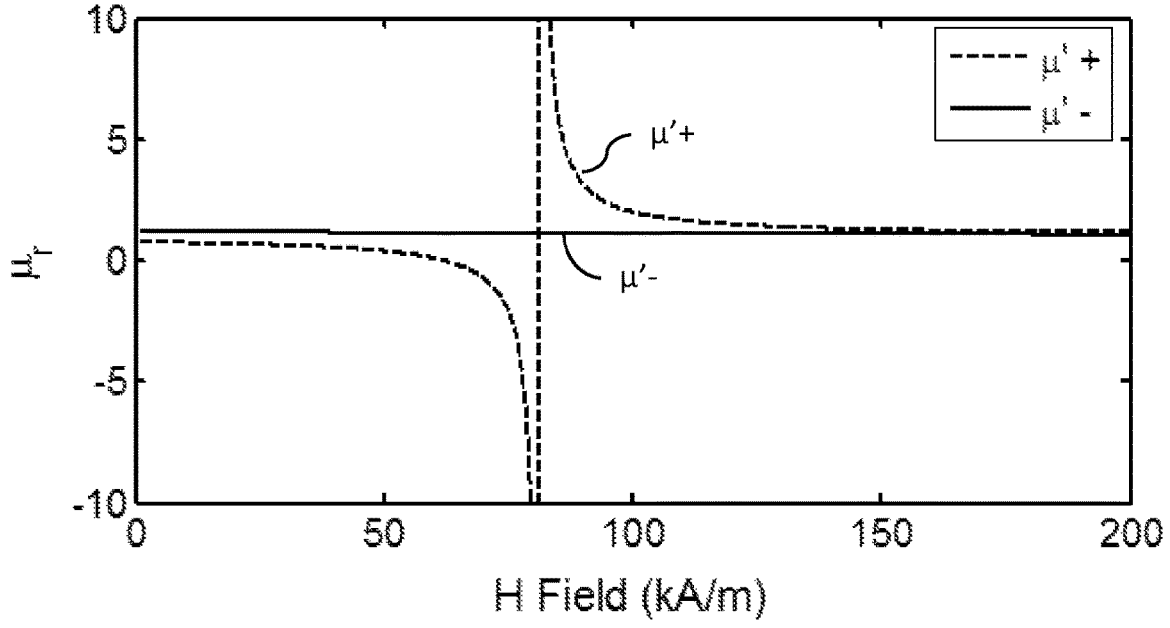
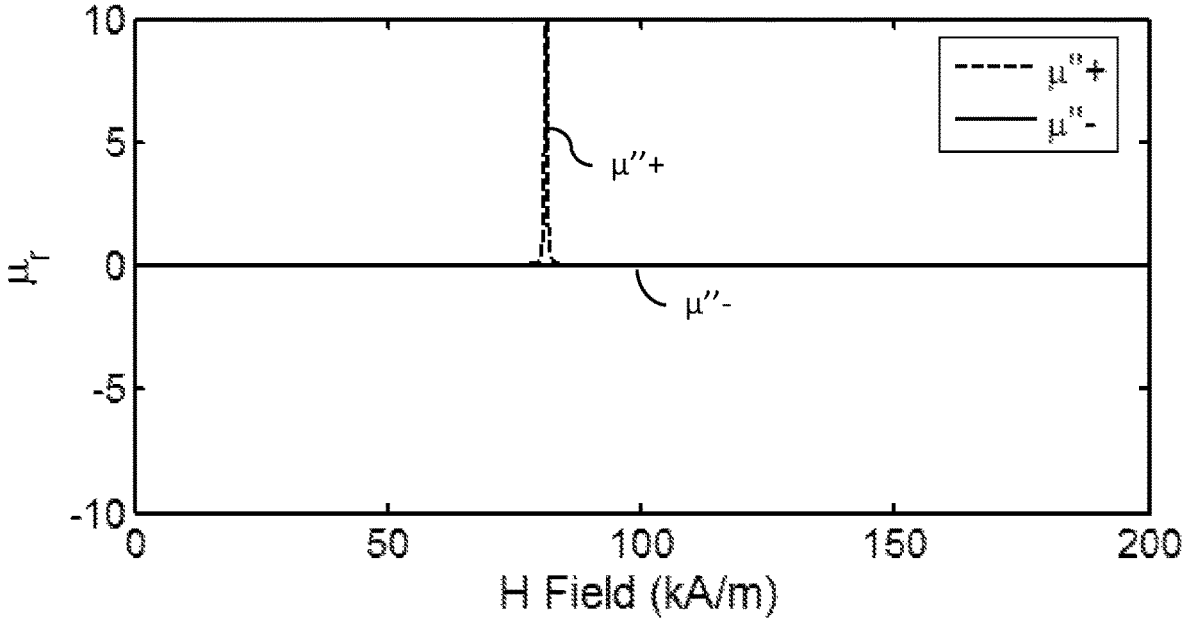
*Fig. 2B*

*Fig. 5A* Forward Power
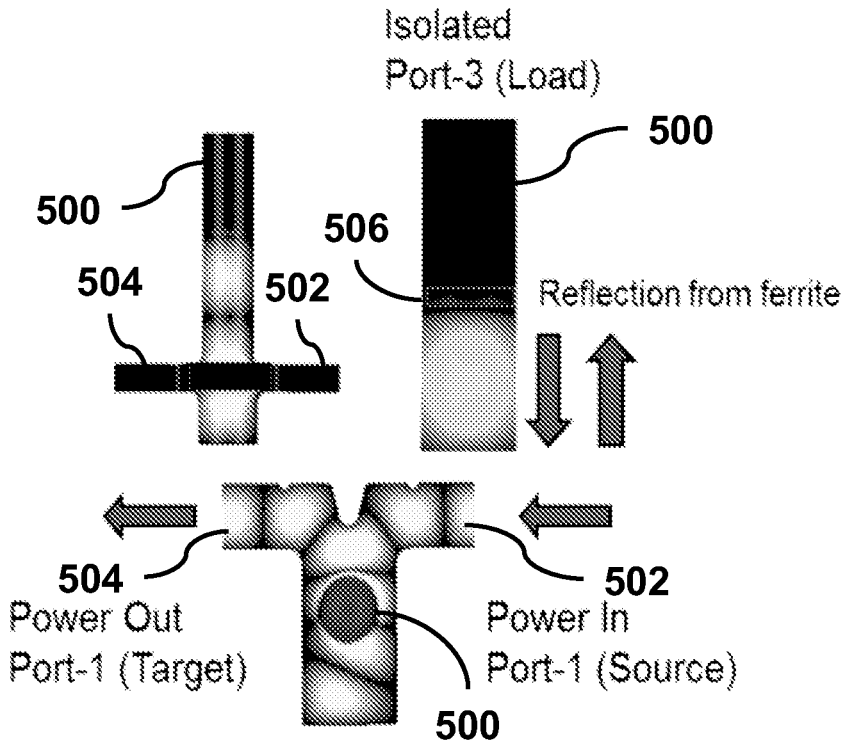
*Fig. 5B* Reflected Power
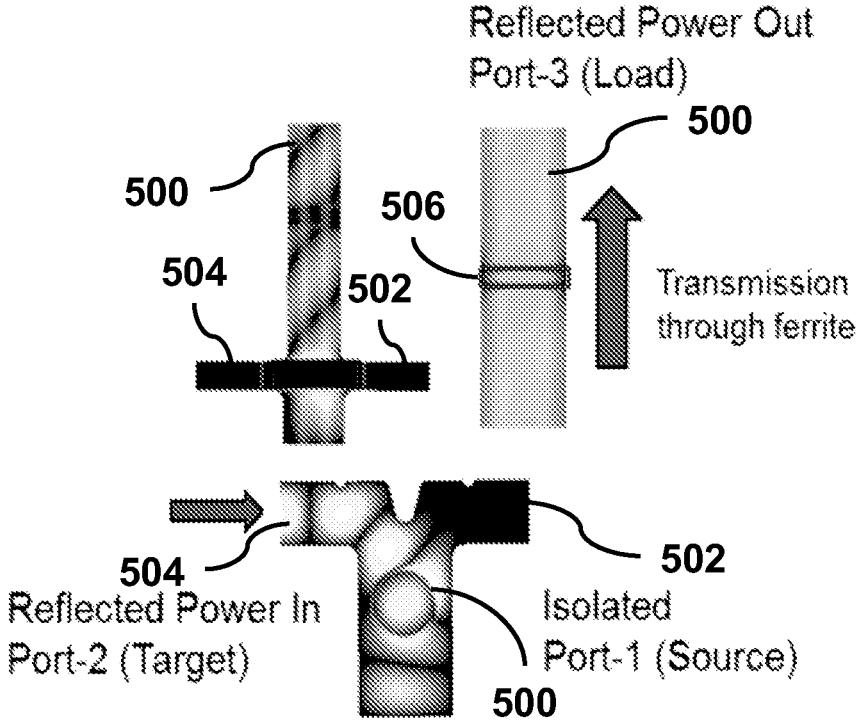

Fig. 6A
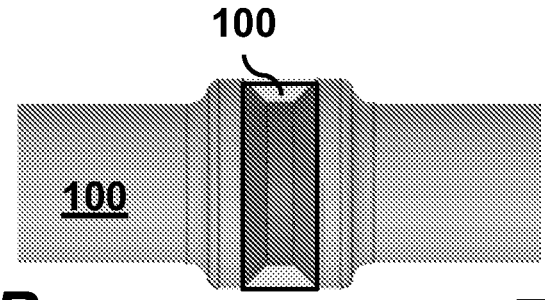
Fig. 6B
Electric Field (Forward)
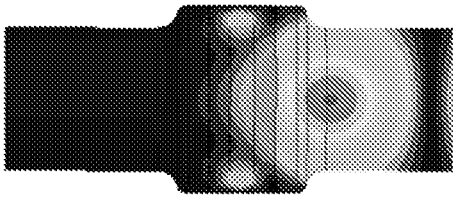
Electric Field (Reverse)
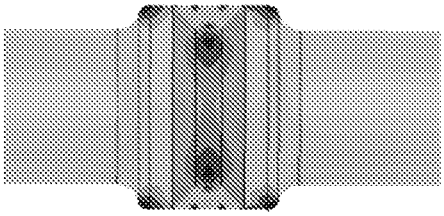
Fig. 6C
Magnetic Field (Forward)
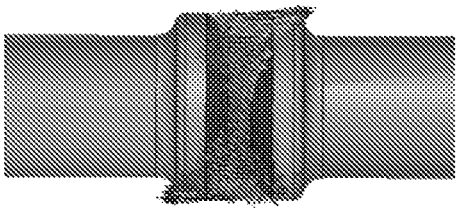
Magnetic Field (Reverse)
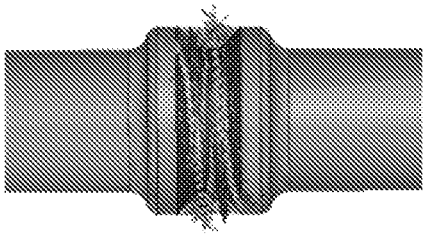
Fig. 6D
Fig. 6E

*Fig. 7A*
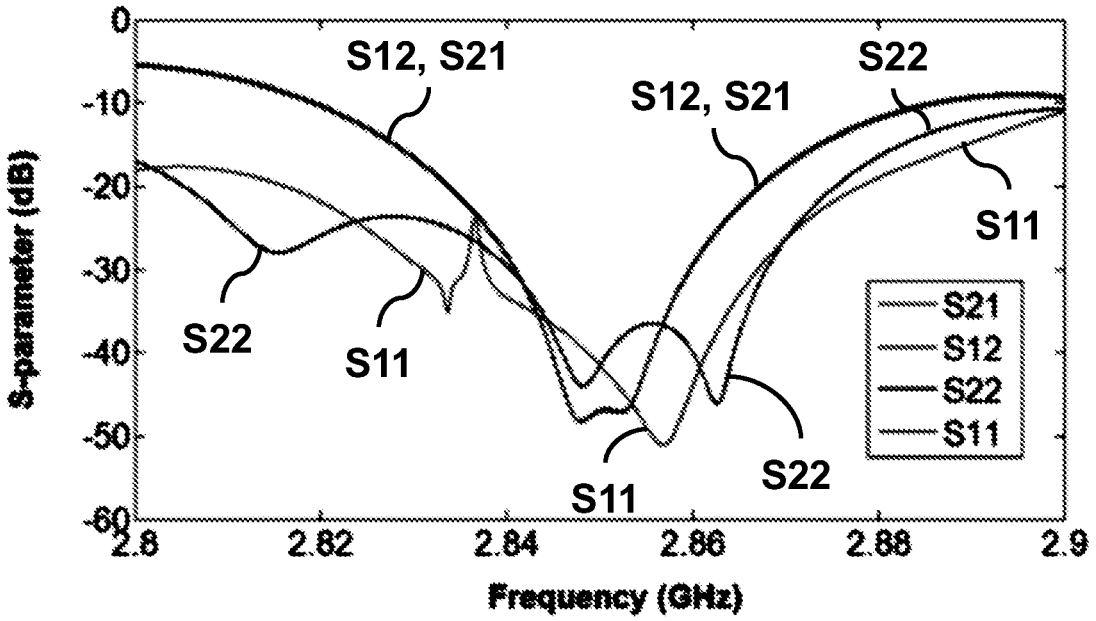
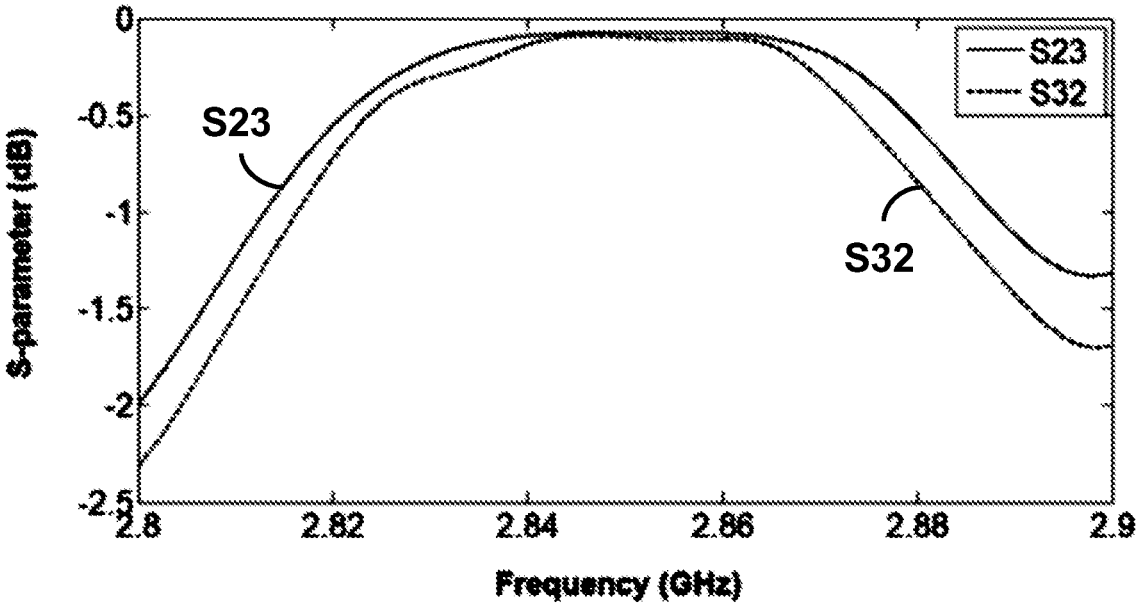
*Fig. 7B*

*Fig. 9A*
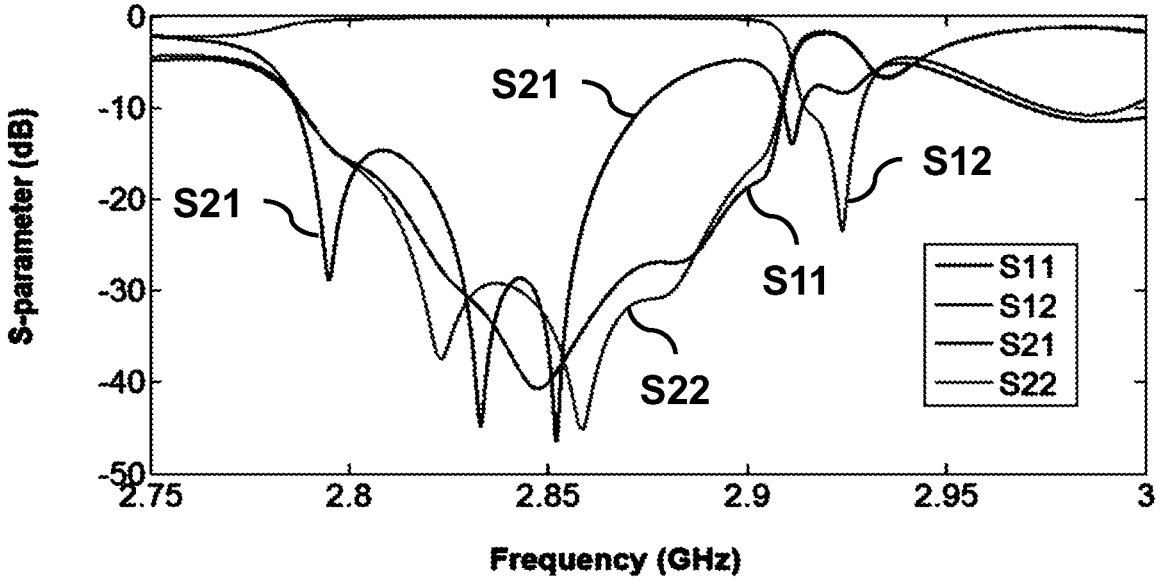
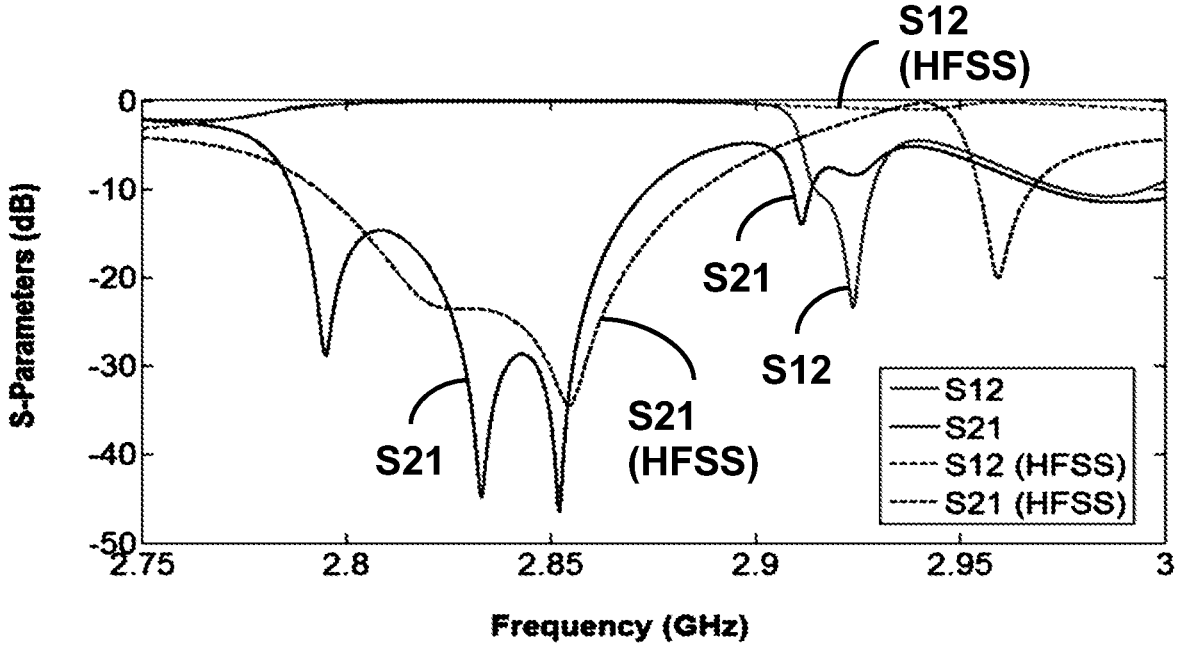
*Fig. 9B*

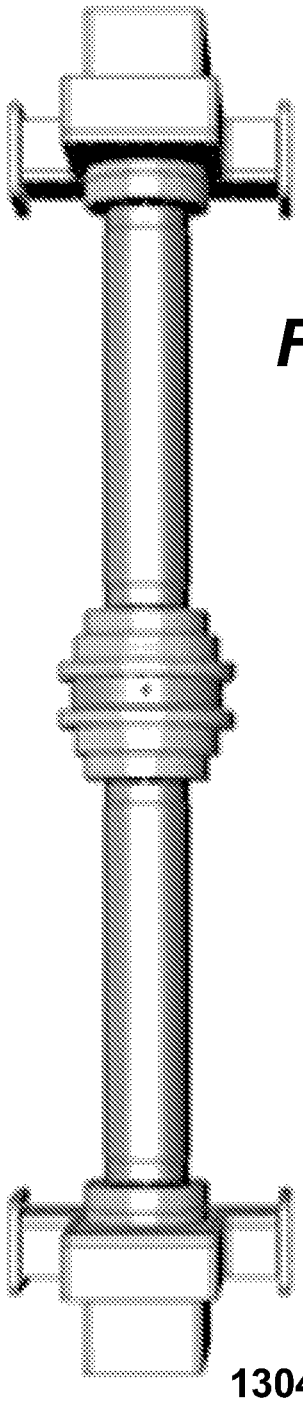
Fig. 13A
Fig. 13B
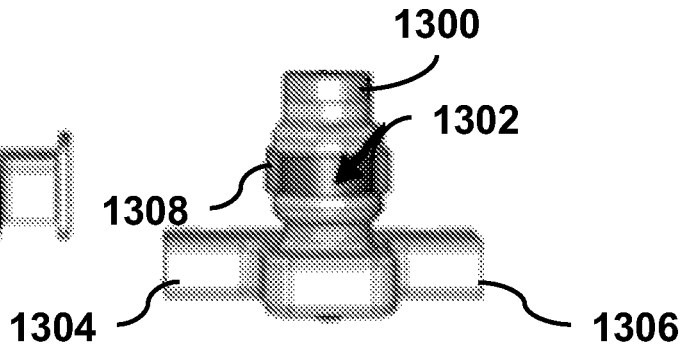

Fig. 14A
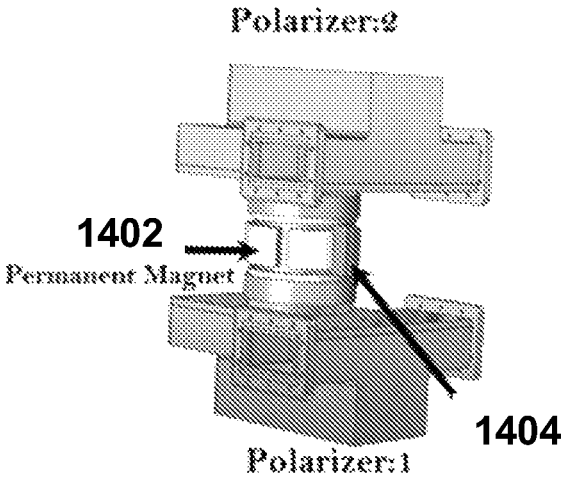
Fig. 14B
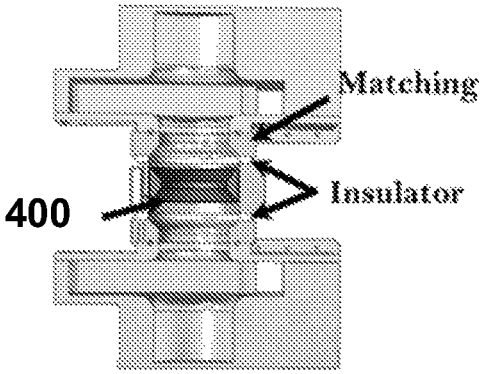
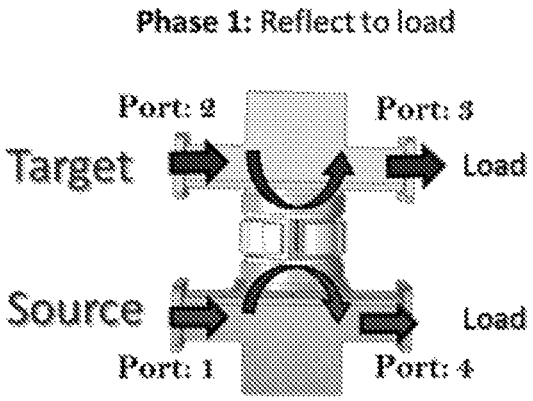
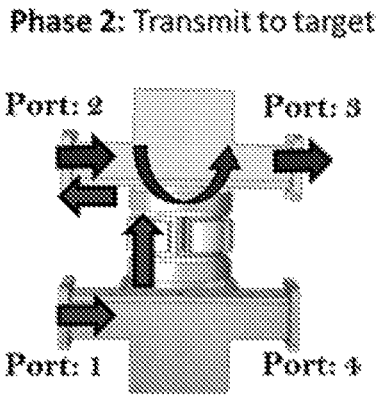
RHCP wave: Power from source (Port:1)
LHCP wave: Power from target (Port:2)
Fig. 14C
Fig. 14D Fig. 15C
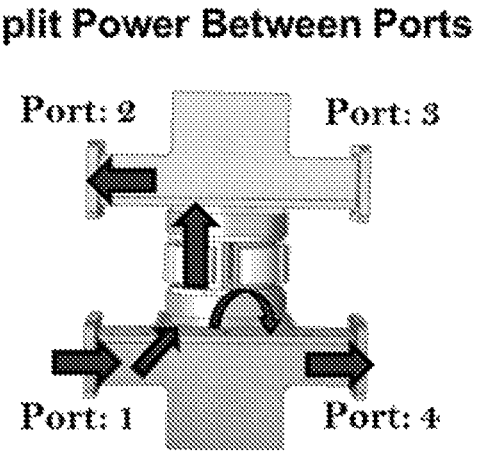
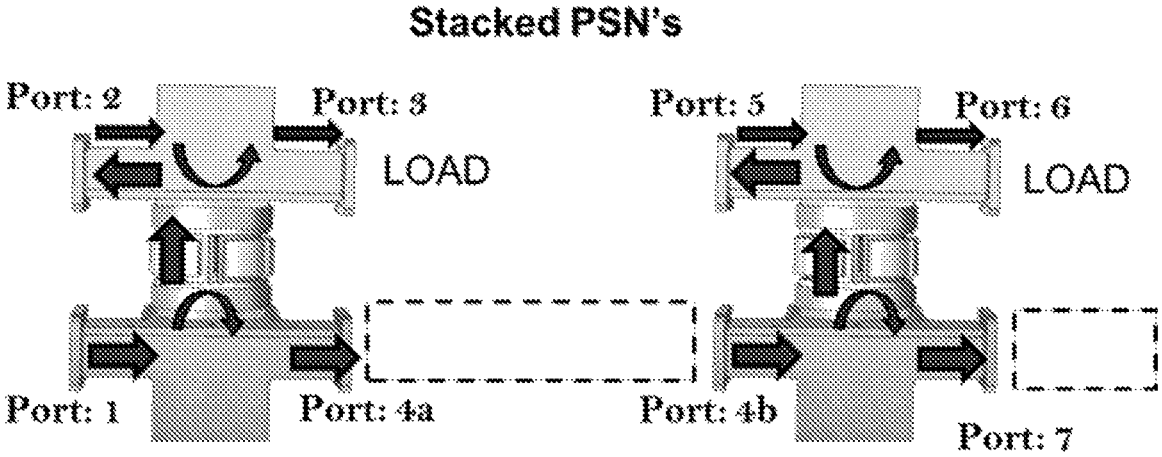
Fig. 15D

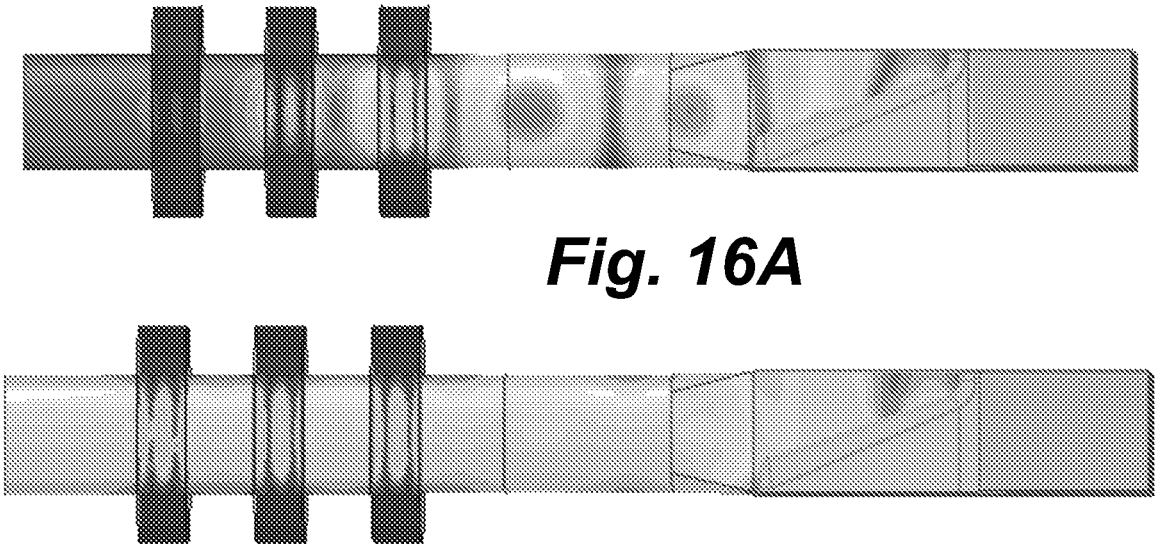
Fig. 16A
Fig. 16B
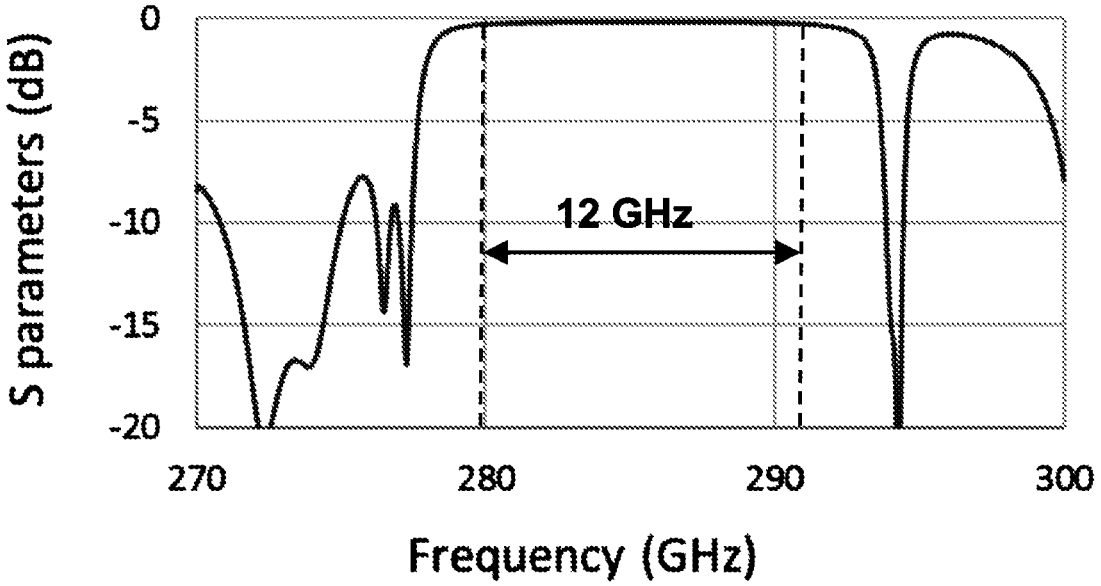

NON-RECIPROCAL MICROWAVE WINDOW

FIELD OF THE INVENTION

The present invention relates generally to high power microwave devices. More specifically, it relates to non-reciprocal microwave devices, such as isolators and circulators.

BACKGROUND OF THE INVENTION

The use of non-reciprocal circuits as protection networks is ubiquitous in nearly all high power microwave (HPM) systems. Existing designs of such devices, such as circulators and isolators, are single input mode devices and typically utilize a ferromagnetic media in waveguide to achieve proper directivity either through Faraday rotation or power cancellation. A traditional Y-junction circulator for example, utilizes a single fundamental mode in rectangular waveguide which is used to excite two gyrotropic, oppositely propagating, modes within a network containing a non-reciprocal element. The size of the device is therefore heavily dependent on the degree of anisotropy of the ferrite as it relates to the required differential phase shift between each mode. Consequently, a moderately compact system must employ a highly anisotropic material, which inherently increases the material's loss and susceptibility to spin waves. These material limitations coupled with the required size and placement of the ferromagnetic material typically limit these protection circuits to input powers below 20 MW at S-band.

Further advancement HPM technology, particularly in the realm of normal conducting radio frequency (NCRF) accelerators and counter electronic applications, requires protection elements capable of handling +100 MW peak power. In order to achieve these operational goals in a cost-effective manner, an over-moded network is applied with at least two or more input and output modes on either end of the ferrite. Application of multiple modes, via analysis of the generalized scattering matrix, is proven approach capable of reducing the number of physical ports and improving the overall power handling of the system.

SUMMARY OF THE INVENTION

Nearly all high power microwave amplifiers use isolators or circulators to protect the expensive microwave source from harmful reflected power. This protection unit is often the limiting factor in determining how much power can be delivered (i.e., to an accelerating structure). The present inventors have demonstrated that by using multiple input modes, a precisely tuned, in-line, ferrite element can be used to replace conventional circulators and isolators while also improving power handling and compactness.

According to the principles of the present invention, a single input mode excites two unique gyrotropic modes within the non-reciprocal element, each traveling azimuthally about the axis of the external bias field (with a left and right hand sense respectively).

According to one aspect of the invention, the non-reciprocal network supports symmetric coupling to both the forward (transmitting) and backward (reflecting) propagating modes in the surrounding over-moded waveguide. The partial reflection from the ferrite naturally splits the incoming power such that complete directivity (transmission or reflection) can only be achieved by application of multiple orthogonal input modes.

The non-reciprocal element may be a solid disk (cylindrical) or plate (rectangular), which may also serve as a physical barrier. This is useful in some applications, e.g., where high power loads require a barrier between vacuum and water, or where vacuum/air interfaces require a barrier. Using the network in this type multifunctional role would make uniquely compact microwave devices.

The non-reciprocal element may be a partially filled (annulus or rod) shape tuned to shape fields. This can eliminate field enhancement (triple points), and distribute Poynting flux (only some of the incoming power goes through the ferrite).

In another aspect of the invention, the waveguides coming into and out of the ferromagnetic element are cylindrical, rectangular, or elliptical in cross section and are capable of supporting two or more modes.

In yet another aspect of the invention these input and/or output waveguides are fed into a microwave polarizer or equivalent hybrid mode converter, capable of discriminating the relative phase of the each supported mode and directing the flow of microwave power accordingly.

This concept can be used for an array of devices that are vital to all high power electronics including circulators, isolators, and phase shifters. All of these devices are widely used in accelerator systems, scientific research, industrial processes and defense applications to protect equipment and mitigate failures.

A non-reciprocal network with corresponding mode converters can be used as a 4 port microwave circulator (one mode converter on each side of network), a 4 port tunable microwave coupler/phase shifter (one mode converter on each side of the network), a 2 port tunable phase shifter (a mode converter on one side of the network, a short circuit on the other), or a 2 port isolator (a mode converter on one side of the network, a matched load on the other).

The ferrite can be biased with a permanent magnet or solenoid without the use of magnetic pole pieces. This allows for ultra-fast circuit response time and can provide an ideal platform for development of a fast switch (rapid adjustment of ferrites reflection/transmission properties) via external magnetic field to control microwave power flow very short time scales.

In yet another aspect, the full system of microwave polarizer with non-reciprocal network may be operated in series to distribute incoming power.

In one aspect, the invention provides a microwave non-reciprocal network device comprising: a source waveguide capable of supporting multiple input/output modes; a target waveguide capable of supporting multiple input/output modes; an inline non-reciprocal network connected to the source waveguide and the target waveguide and comprising a non-reciprocal media element; wherein the inline non-reciprocal network is tuned such that each of multiple linearly polarized input modes couples equally into supported modes of the source and target waveguide moving forward and backward; wherein the inline non-reciprocal network is adapted to cancel the forward or backward waves depending on a relative phase difference between two or more orthogonal input signals to the network.

Optionally, the source waveguide and target waveguide are connected to passive hybrid mode converters capable of directing power to standard waveguide based on relative phase. Optionally, the non-reciprocal media element acts to produce non-reciprocal directivity in a two port isolator configuration or a four port circulator configuration. Optionally, the non-reciprocal media element at least partially fills a region of the inline non-reciprocal network that supports at least half of a guided wavelength. Optionally, the non-reciprocal media element is a cylindrical disk, rectangular plate, cylindrical annulus, or rectangular annulus. Optionally, a housing of the non-reciprocal media element has a circular, rectangular, elliptical or coaxial cross section. Optionally, the source waveguide has a circular, rectangular, elliptical, or coaxial cross section. Optionally, the target waveguide has a circular, rectangular, or elliptical cross section. Optionally, the non-reciprocal media element is biased by a permanent magnet and/or solenoid with or without pole pieces. Optionally, the inline non-reciprocal network comprises multiple non-reciprocal elements placed in series to produce a desired directivity. Optionally, the non-reciprocal media element is biased above or below a gyromagnetic resonance to achieve directivity. Optionally, the non-reciprocal media element is biased at gyromagnetic resonance to achieve RF absorption. Optionally, the non-reciprocal element is adapted to function also as a physical barrier or mode converter. Optionally, the non-reciprocal element is one contiguous piece or multiple connected or disconnected pieces.

BRIEF DESCRIPTION OF THE DRAWINGS

FIG. 1A shows the H-plane embodiment of a high power microwave polarizer with the normalized electric field contours for input power at port: 1 and a matched load at port: 2 and port: 3.

FIG. 1B shows the H-plane embodiment of a high power microwave polarizer with the normalized electric field contours for input power at port: 2 and a matched load at port: 1 and port: 3.

FIG. 1C shows the E-plane embodiment of a high power microwave polarizer with the normalized electric field contours for input power at port: 1 and a matched load at port: 2 and port: 3.

FIG. 1D shows the E-plane embodiment of a high power microwave polarizer with the normalized electric field contours for input power at port: 2 and a matched load at port: 1 and port: 3.

FIG. 2A-B shows graphs of the real and imaginary components of the ferrites permeability as observed by the right hand (+) and left hand (−) gyrotropic modes as a function of the externally applied bias field ($H_o$) at S-band (2.856 GHz).

FIGS. 5A-B shows the fundamental mode disk embodiment from FIG. 3A connected to an H-plane microwave polarizer with (FIG. 5A) depicting the normalized electric field contours for a unit of input power at port: 1 (matched loads at ports: 2/3) and (FIG. 5B) depicting the normalized electric field contours for a unit of input power at port: 2 (matched loads at ports: 1/3).

FIGS. 6A-E illustrates the non-reciprocal network embodiment of FIG. 3C with trapezoidal cross section including (FIG. 6A) a longitudinal cross section as depicted in FIG. 3C, (FIG. 6B) the normalized electric field contours produced by a left-hand circularly polarized wave, (FIG. 6C) a vector plot of the magnetic field produced by a left-hand circularly polarized wave, (FIG. 6D) the normalized electric field contours produced by a right-hand circularly polarized wave, and (FIG. 6E) a vector plot of the magnetic field produced by a right-hand circularly polarized wave.

FIG. 7A shows a plot of the measured cold test S-parameters of a single H-plane microwave polarizer from FIG. 1A-B.

FIG. 7B shows the insertion loss of two H-plane polarizers adjoined by a common cylindrical waveguide carrying the left hand circularly polarized wave.

FIGS. 9A-B shows (FIG. 9A) the measured insertion loss ($S_{21}$,$S_{12}$) and return loss ($S_{11}$,$S_{22}$) of the 4-port circulator configuration from FIG. 8 with the fundamental mode disk ferrite from FIG. 3A and (FIG. 9B) the measured insertion loss as compared to the simulated values in HFSS with a magnetic field bias of approximately 50 kA/m.

FIGS. 13A-B shows (FIG. 13A) the 4-port circulator configuration from FIG. 8 (without the solenoid), and (FIG. 13B) a more compact 2-port isolator configuration featuring a permanent magnet and matched load proximal to the ferrite.

FIGS. 14A-D show an embodiment of the invention wherein the ferrite is primary biased by an external permanent magnet array, concentric with the ferrite.

FIG. 15D shows an embodiment with multiple assemblies as shown in FIG. 14A assembled in series via their standard waveguide inputs.

FIG. 16A shows an embodiment in which non-reciprocal elements (ferrites) themselves are placed in series along the source and target waveguide.

FIG. 16B illustrates the transmission bandwidth of the circuit depicted in FIG. 16A.

DETAILED DESCRIPTION

Figure 3A:
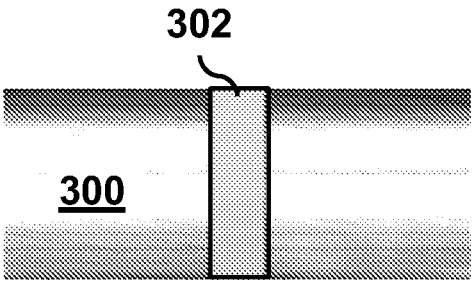
FIGS. 3A-D illustrates the four designed embodiments of the device in cylindrical waveguide, with the external bias field in the Z+ direction (right to left), including (FIG. 3A) the fundamental $HE_{11}$ disk wherein the ferrite radius is approximately equal to that of the incoming/outgoing waveguide, (FIG. 3B) an over-moded disk which is much larger than the surrounding guide, (FIG. 3C) An annulus configuration with a trapezoidal cross section, and (FIG. 3D) an annulus configuration with a circular cross section.

Ferrite media is utilized to alter the passive behavior of a multi-mode hybrid/polarizer in order to achieve non-reciprocal directivity in the circuit. This new topology achieves this functionality by exploitation of the inherent coupled mode relations in an anisotropic material, where in a single input mode can excite a number of gyrotropic modes inside of a biased ferrite which, in turn, may excite several additional modes within the input and output waveguide. Proper tuning of the ferrite enables a single input signal to couple equally to the available modes supported by the surrounding waveguide both moving forward and backward. The introduction of the second mode provides for exact power cancellation of the forward or backward wave depending on the relative phase difference of the two input signals, allowing for either transmission or reflection of the multi-mode input. When coupled with a hybrid or polarizing mode launcher, the system is easily able to discriminate the power incident on one port versus another either as 4-port circulator or a 2-port isolator. For purposes of illustration, the embodiments described in this disclosure focus on the use of polarizing mode launchers as they produce an ideal phase delay between degenerate $TE_{11}$ modes to achieve isolation from the non-reciprocal network.

Polarizer:

A microwave polarizer is a very robust mechanism to discriminate or produce left and right hand circularly polarized waves. The two devices as shown in FIGS. 1A-D are both 3-port, 4-mode, passive devices that takes an input $TE_{10}$ rectangular waveguide mode and produces two $TE_{11}$ modes in quadrature to create a left hand (LH) or right hand (RH) circularly polarized wave in cylindrical waveguide. As shown in FIG. 1A and FIG. 1C, careful tuning of the device maintains complete directivity from the input port 1 (100, 106) to the output port 3 (104,110) while leaving the second rectangular waveguide port 2 (102,108) completely isolated due to power cancellation in the over-moded network. As shown in FIG. 1B and FIG. 1D, any power that is reflected within the cylindrical waveguide experiences a 180 degree change in its direction of propagation such that returning signal will cancel at port 1 (100,106) and completely transmit to the second rectangular waveguide port 2 (102,108). These devices are designed in both H-plane (FIG. 4A-B) and E-plane (FIG. 4C-D) configurations. More specifically, these polarizer devices feature an H-plane polarizer with RHCP wave excitation (FIG. 1A), an H-plane polarizer with LHCP wave excitation (FIG. 1B), an E-plane polarizer with RHCP wave excitation (FIG. 1C), and an E-plane polarizer with LHCP wave excitation (FIG. 1D).

An unmodified conventional polarizer in and of itself, however, is a purely passive component and cannot serve as a protection element as it follows general rules of reciprocity. In order to achieve non-reciprocal signal behavior required for an isolator or circulator, these polarized waves are manipulated in a manner that directs or attenuates the signal based on its sense of rotation. This class of device is thus utilized as an elegant means of providing proper signal composition and phase for the non-reciprocal "window" discussed in this paper.

Device Operation:

In embodiments of the invention, a non-reciprocal network operates on the basis of dividing the incident power by reflection and transmission through the ferrite media with a specifically tuned phase shift between each mode, similar in basic principle to that of a conventional vacuum window. However, since the goal of the device is to non-reciprocally transmit or reflect 100% of the incident wave, a multi-moded system is used (in this case two modes) where by the power can be cancelled on one side of the ferrite, or the other, based upon the phase delay between the incident signals. Perfect cancellation of the power on one side of the ferrite requires two conditions to produce the following S-parameter matrix unique to this device:

$$S = \begin{pmatrix} \cdot & S_{1:1} & S_{1:2} & S_{2:1} & S_{2:2} \\ S_{1:1} & -6(0) & -6(90) & -6(\delta) & -6(\delta+90) \\ S_{1:2} & -6(-90) & -6(0) & -6(\delta+90) & -6(\delta-180) \\ S_{2:1} & -6(\delta) & -6(\delta-90) & -6(0) & -6(-90) \\ S_{2:2} & -6(\delta-90) & -6(\delta-180) & -6(90) & -6(0) \end{pmatrix}$$

1. Equal power coupling to all four modes and,
2. A 180 degree phase shift in the coupled mode terms:

$S_{port1:mode1,\ port2:mode2}$ $S_{1:1,1:2}=S_{1:2,1:1}-180$ $S_{2:1,2:2}=S_{2:2,2:1}-180$ $S_{2:1,1:2}=S_{1:2,2:1}-180$ $S_{1:1,2:2}=S_{2:2,1:1}-180$ Similar to the conventional circulator, both the right and left hand gyrotropic modes are excited within the ferrite to achieve proper coupling to the external network. However, unlike conventional circulators/isolators, these conditions can be achieved purely by manipulation of the ferrites boundary conditions and can be sub-wavelength. Additionally, the heavily over-moded systems can produce distinctly unique field patterns between each excited gyrotropic mode which drastically alleviate the demand on the material anisotropy and allow for lower loss, higher power handling, ferrites. Table 1 shows the electrical design parameters of four different cylindrical embodiments of the non-reciprocal network. The second embodiment in particular, labeled "Over-moded disk", was able to achieve proper directivity using a material with a magnetic saturation of 240 G at a magnetic bias field of 140 kA/m.

TABLE 1

Simulated results for the four ferrite configurations shown in FIGS. 3A-D.

| | Isolation | −30 dB isolation BW | Insertion Loss | Loss Ferrite (LHCP/RHCP) | Magnetic Saturation | Loss Tangent | Bias Field (A/m) |
|---|---|---|---|---|---|---|---|
| HE-11 Disk | −35 dB | 8.5 MHz | −0.05 dB | 0.67%/3.8% | 680 G | 25 Oe | 49 kA/m |

TABLE 1-continued

Simulated results for the four ferrite configurations shown in FIGS. 3A-D.

| | Isolation | −30 dB isolation BW | Insertion Loss | Loss Ferrite (LHCP/RHCP) | Magnetic Saturation | Loss Tangent | Bias Field (A/m) |
|---|---|---|---|---|---|---|---|
| Over-moded disk | −45 dB | 25 MHz | −0.095 dB | 0.5%/1.8% | 240 G | 21 Oe | 141 kA/m |
| Annulus (1a) | −80 dB | 8.5 MHz | −0.04 dB | 1.0%/2.4% | 814 G | 24 Oe | 138 kA/m |
| Annulus (2a) | −50 dB | 25 MHz | −0.07 dB | 1.3%/0.95% | 814 G | 24 Oe | 140 kA/m |

The equations for the real and imaginary components of the ferrites permeability for the right (+) and left (−) hand gyrotropic modes are $$\mu'_{\pm} = 1 + \frac{M_s}{\left(\frac{f_0}{\gamma}\right)}\left(\frac{\frac{H}{\frac{f_0}{\gamma}} \mp 1}{\left(\frac{H}{\frac{f_0}{\gamma}} \mp 1\right)^2 + \left(\frac{\delta H}{\frac{2f_0}{\gamma}}\right)^2}\right)$$

$$\mu''_{\pm} = \frac{M_s}{\left(\frac{f_0}{\gamma}\right)}\left(\frac{\left(\frac{\delta H}{\frac{2f_0}{\gamma}}\right)}{\left(\frac{H}{\frac{f_0}{\gamma}} \mp 1\right)^2 + \left(\frac{\delta H}{\frac{2f_0}{\gamma}}\right)^2}\right)$$

According to these equations, as graphed in FIGS. 2A-B, the high (above resonance) bias coupled with a low magnetic saturation material produces a difference in the real component of permeability of approximately 20% (μ+=1.32, μ−=1.08). The loss term (μ"+) as shown in FIG. 2B approaches zero as the external magnetic bias increases above the gyromagnetic resonance field for operation at 2.856 GHz. The net loss in ferrite, in simulation, was less than 1% which translated to an insertion loss below 0.1 dB for the full circulator model.

Figure 3C:
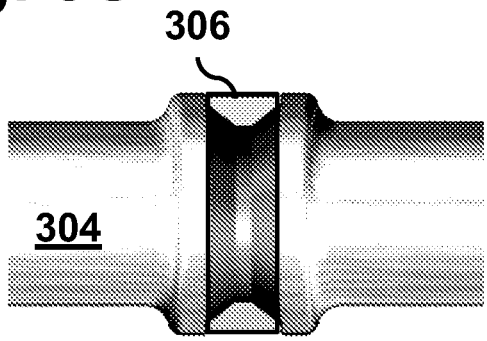
Figure 3B:
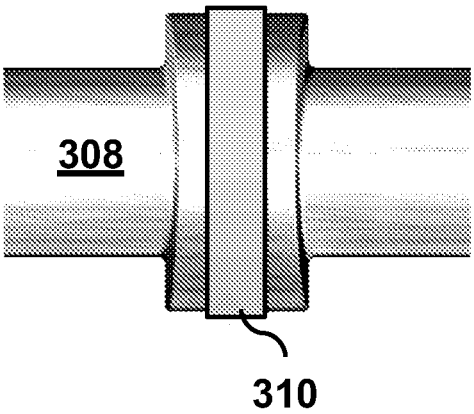
Figure 3D:
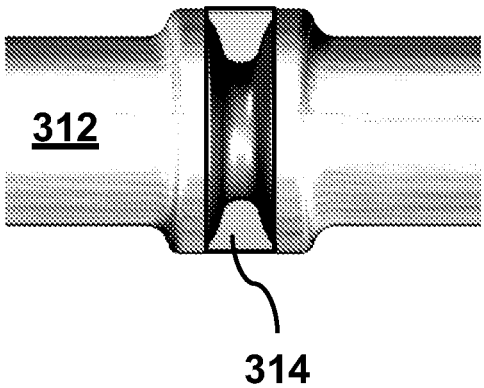

FIGS. 3A-D depicts the longitudinal cross section the same four embodiments from Table 1. These geometries when coupled with a polarizing mode launcher, achieve the functionality of a circulator or isolator. FIG. 3A shows a simple $HE_{11}$ mode disk 302 in waveguide 300. FIG. 3B shows an over-moded disk 310 in waveguide 308. FIG. 3C shows an annulus 306 in waveguide 304, and FIG. 3D shows an annulus 314 in waveguide 312.

Figures 4A, 4B:
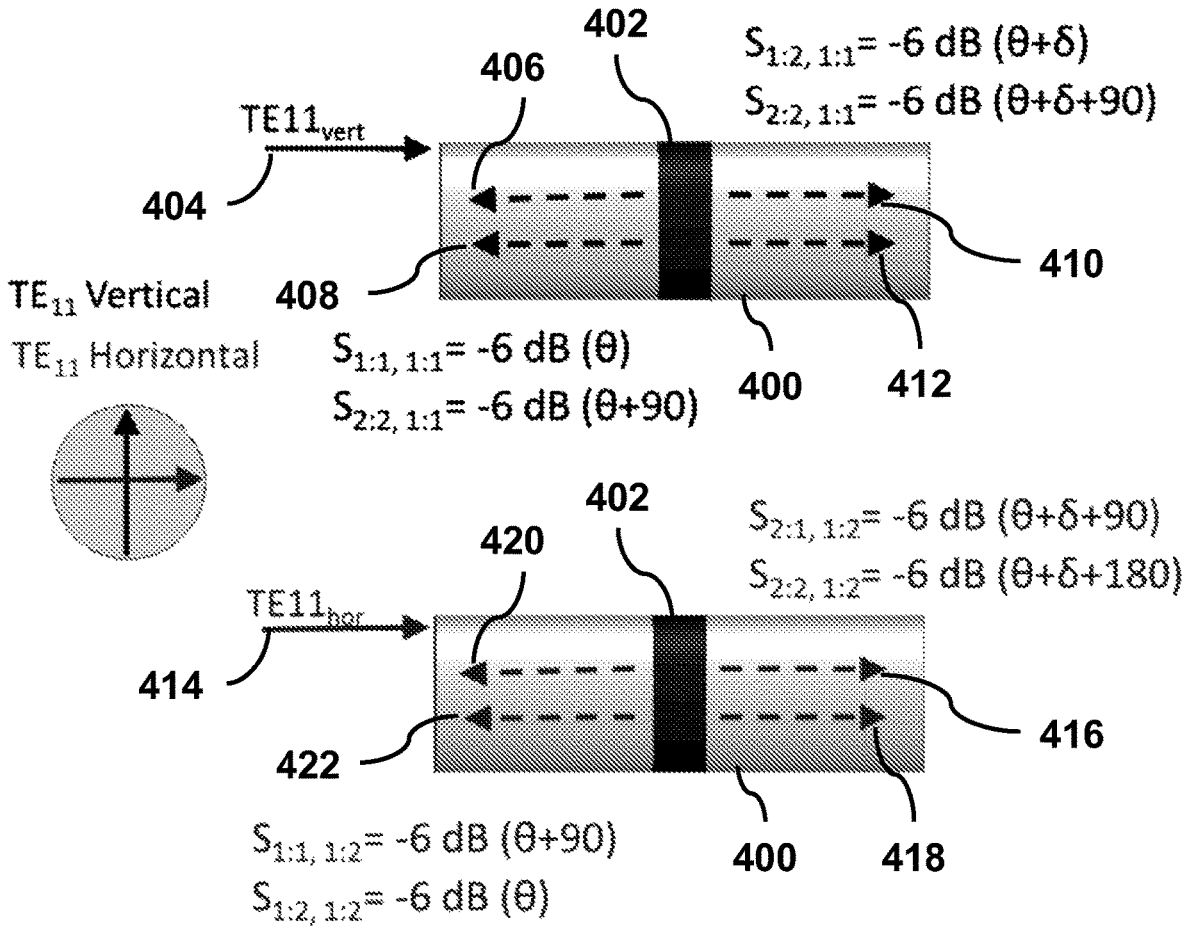
FIGS. 4A-B shows the fundamental mode disk illustrated in FIG. 3A with (FIG. 4A) the amplitude and phase of the two incoming and two outgoing modes generated by a linearly polarized mode in the vertical direction and (FIG. 4B) with amplitude and phase of the four modes generated by a second (degenerate) linearly polarized mode in the horizontal direction, with a 90 degree phase delay.

FIGS. 4A-B illustrate a simple implementation where the input/output cylindrical waveguide 400 supports the fundamental ($TE_{11}$) mode as well as its degenerate counterpart. As shown in FIG. 4A, the system is designed such that a single incident $TE_{11}$ mode 404 from the waveguide will simultaneously excite two fundamental gyrotropic modes within the ferrite 402, the $HE_{11}$− and the $HE_{11}$+ (which remains cutoff in the system). The ferrite is tuned such that these gyrotropic modes perfectly excite two $TE_{11}$ modes 410, 412 moving forward and two modes 406, 408 moving back backward within the surrounding cylindrical waveguide 400; essentially producing two polarized waves moving in opposite directions. As shown in FIG. 4B, the addition of the second degenerate mode 414, orthogonal to the first mode 404 and in quadrature (additional 90 degrees of phase advance or lag), produces two $TE_{11}$ modes 416, 418 moving forward and two modes 420, 422 moving back backward within the surrounding cylindrical waveguide 400; for a total of 8 modes (4 moving forward and 4 moving backward). If this phase difference is positive (90 degrees) the four modes 406, 408, 420, 422 moving backward will all cancel and 100% of the power (negating loss) will transmit forward. Conversely, if the phase difference is −90 degrees the opposite will be true, and the four modes moving forward 410, 412, 416, 418 will cancel and 100% of the power will reflect backward.

As illustrated in FIG. 5A and FIG. 5B, an embodiment of the device protects a source port from power reflected back from a target port. The figures show a circular waveguide 500 with ferrite element 506 connected to a microwave polarizer, with source waveguide port 502 and target waveguide port 504.

As shown in FIG. 5A, power input from source port 502 (in the form of a $TE_{10}$ mode) is transformed into a left hand circularly polarized wave by the mode launcher where in a +90 degree relative phase exists between the two $TE_{11}$ modes. This phase difference distinctly cancels the propagating $HE_{11}$+ mode leaving the remaining, cutoff, $HE_{11}$− mode. The input signal thus observes a pure reflection with very little field existing within the non-reciprocal media 506. The reflected power signal from the ferrite 506 preserves the relative phase of the two $TE_{11}$ modes but the direction of propagation is now opposite the incident signal. The reflected wave thus behaves in the opposite manner within the polarizer and is directed to target port 504.

As shown in FIG. 5B, any power that is reflected from the target 504 will enter back into the polarizer but this time couple to a right hand polarized wave. The wave will cancel the cutoff $HE_{11}$− mode, eliminating the reflected power, and the full signal will propagate through the ferrite 506 (via $HE_{11}$+) and through waveguide 500 to a secondary target or load providing complete protection of the source 502.

The shape of the ferrite element in FIG. 5A-B is not limited to a simple "window-like" geometry and can be shaped to provide a more advantageous field configuration for lower loss and breakdown susceptibility. An annulus geometry for example can both reduce the complexity of the external bias network and produce an extremely low loss field configuration. Similar to the $HE_{11}$ mode disk, one linearly polarized wave excites two gyrotropic modes within the non-reciprocal network which then couple equally to the modes supported by the surrounding waveguide to produce the S-parameter matrix. FIGS. 6A-6E show the electromagnetic field configurations for both of these modes when excited by circularly polarized waves. The trapezoidal cross section annulus ferrite in FIG. 6A produces two distinctly different sets of gyrotropic modes a TE like right-hand circularly polarized wave and a TM like left hand circularly polarized wave. The superposition of the second degenerate mode, in quadrature, will necessarily cancel one of these gyrotropic modes depending on if the second wave is (+90 degrees) or (−90 degrees) out of phase. This cancellation provides precise directivity for the input mode, allowing for either complete transmission via the TM like hybrid mode or complete reflection via the TE like hybrid mode. Notably, since the TE like mode, whose normalized electric field contour is shown in FIG. 6B, has a predominantly $H_z$ field component within the non-reciprocal media as illustrated in FIG. 6C, the magnetic loss tangent is minimized and the ferrite behaves more like a low loss dielectric insulator. The TM like mode, whose normalized electric field contour plot is shown in FIG. 6D, has magnetic field vector predominantly in the transverse (azimuthal direction) as illustrated in FIG. 6E.

The experimental work was performed using a 4-port circular system requiring one microwave polarizer on either end of the non-reciprocal network. Since the circularly polarized wave output of a single microwave polarizer is not readily adaptable to a network analyzer, the polarizers were cold tested as a single assembled unit (adjoined via the cylindrical waveguide) to produce a 4-port network. FIG. 7A shows the measured insertion loss ($S_{21}$ and $S_{12}$) as well as the return loss ($S_{11}$ and $S_{22}$) of a single polarizer within the assembly as measured by an Agilent 5242A pulsed network analyzer. Since there is no ferrite installed in this cold-test all of the power into port: 1 or port: 2 over the band of 2.84 to 2.865 GHz is transmitted to the other side of the device with very little power (−35 dB+reflected or leaked). FIG. 7B shows the two port transmission insertion loss ($S_{32}$ and $S_{23}$) from one polarizer to the other. Since this particular system is entirely passive, the network should be entirely reciprocal and any variation between $S_{23}$ and $S_{32}$ can be attributed to manufacturing/symmetry differences.

Figure 8:
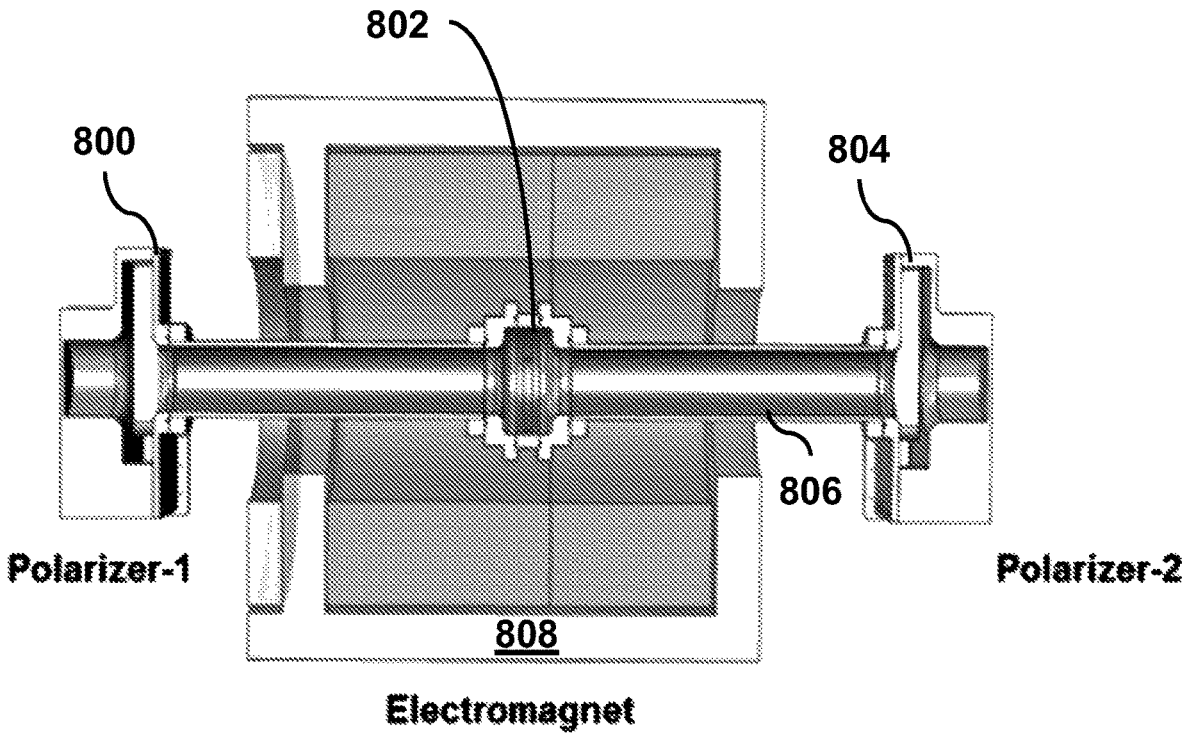
FIG. 8 illustrates the 4-port circulator experimental setup including two H-plane microwave polarizers connected to either end of the over-moded disk ferrite from FIG. 3B with a large solenoid surrounding the system to generate a uniform bias field.

The full four port-4 circulator, as shown in FIG. 8, was assembled in a similar capacity as the cold test from FIG. 7A-B with the inclusion of the non-reciprocal network to provide the proper directivity. Here, two H-plane microwave polarizers 800, 804 connected to either end of the over-moded disk ferrite 802 from FIG. 3B via a cylindrical waveguide 806 capable of supporting the left or right hand circularly polarized wave. A magnetic uniform magnetic field bias in the + or −Z direction (axial) was supplied with a large solenoid surrounding the system 808 to generate the 140 kA/m magnetic field within the ferrite.

Experimental cold test of the 4-port circular were performed with both disk configuration from FIG. 3A (fundamental mode) and FIG. 3B (over-moded) installed as the non-reciprocal element. FIG. 9A depicts the measured insertion loss ($S_{12}$ and $S_{21}$) and return loss ($S_{11}$ and $S_{22}$) from one side of the circulator in the same manner as measured in FIG. 7A but with the inclusion of the non-reciprocal $HE_{11}$ mode disk from FIG. 3A. Here only introduced at a single port (port: 1) is transmitted through the waveguide, producing isolation to port: 2 of more than 30 dB while the power input at port: 2 is reflected off of the and transmitted to port: 1 with an insertion loss of 0.2 dB over a 15 MHz bandwidth. FIG. 9B shows the agreement between the measured insertion loss terms ($S_{12}$ and $S_{22}$) with the simulated model from HFSS.

Figure 10A:
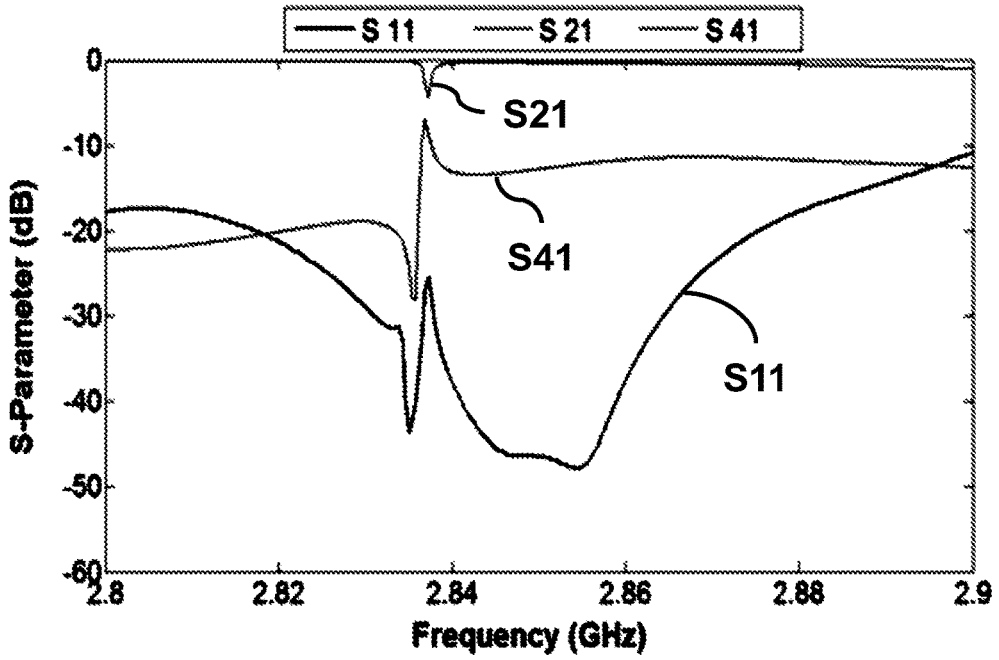
FIGS. 10A-D shows (FIG. 10A) the portal measured insertion loss ($S_{21}$), return loss ($S_{11}$), and power leakage ($S_{41}$) of the 4-port circulator configuration from FIG. 8 with the over-moded disk ferrite from FIG. 3B with a magnetic field bias of approximately 140 kA/m, (FIG. 10B) the port: 2 measured insertion loss ($S_{32}$), return loss ($S_{22}$), and power leakage ($S_{12}$) for the same configuration, (FIG. 10C) a drawing of the experimental layout with labeled ports (1-4) and a flow diagram showing the directivity of RF power when applied at port: 1, and (FIG. 10D) the same drawing with a flow diagram showing the directivity of RF power when applied at port: 2.
Figure 10C:
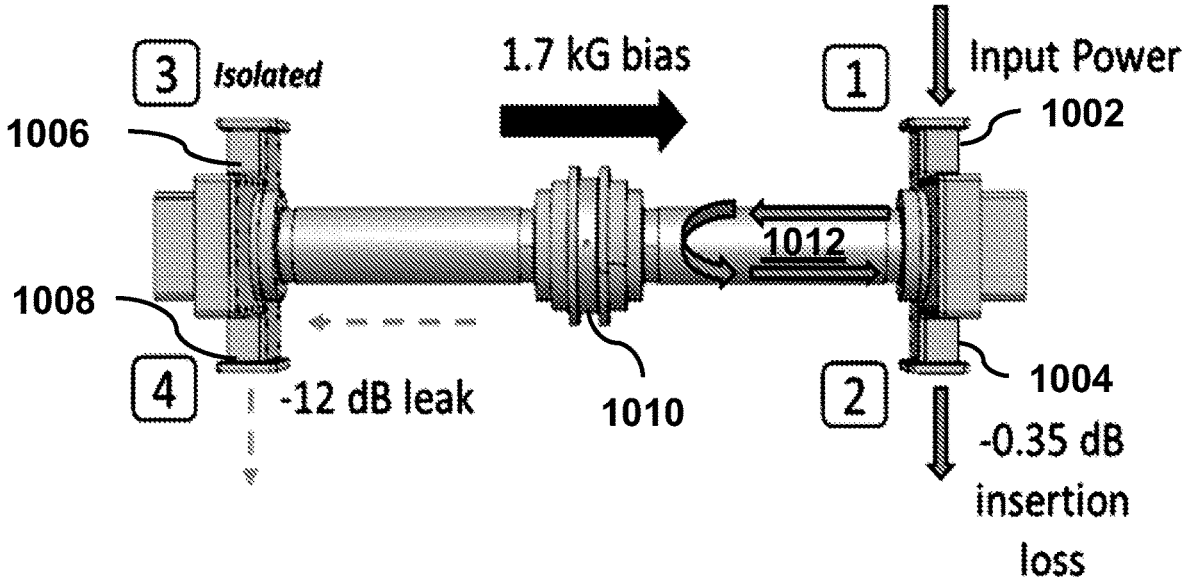
Figure 10B:
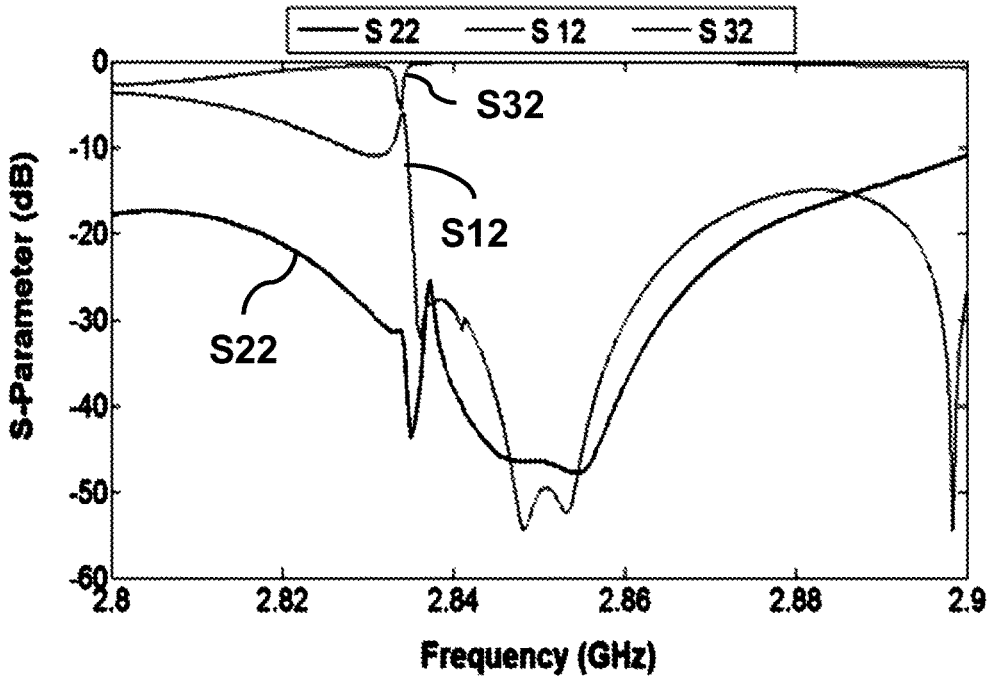
Figure 10D:
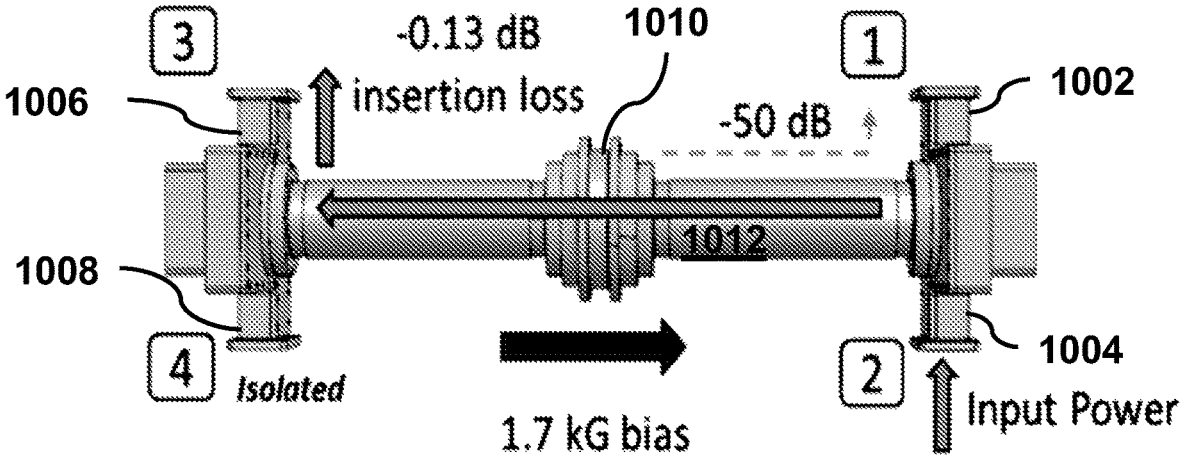
Figure 11:
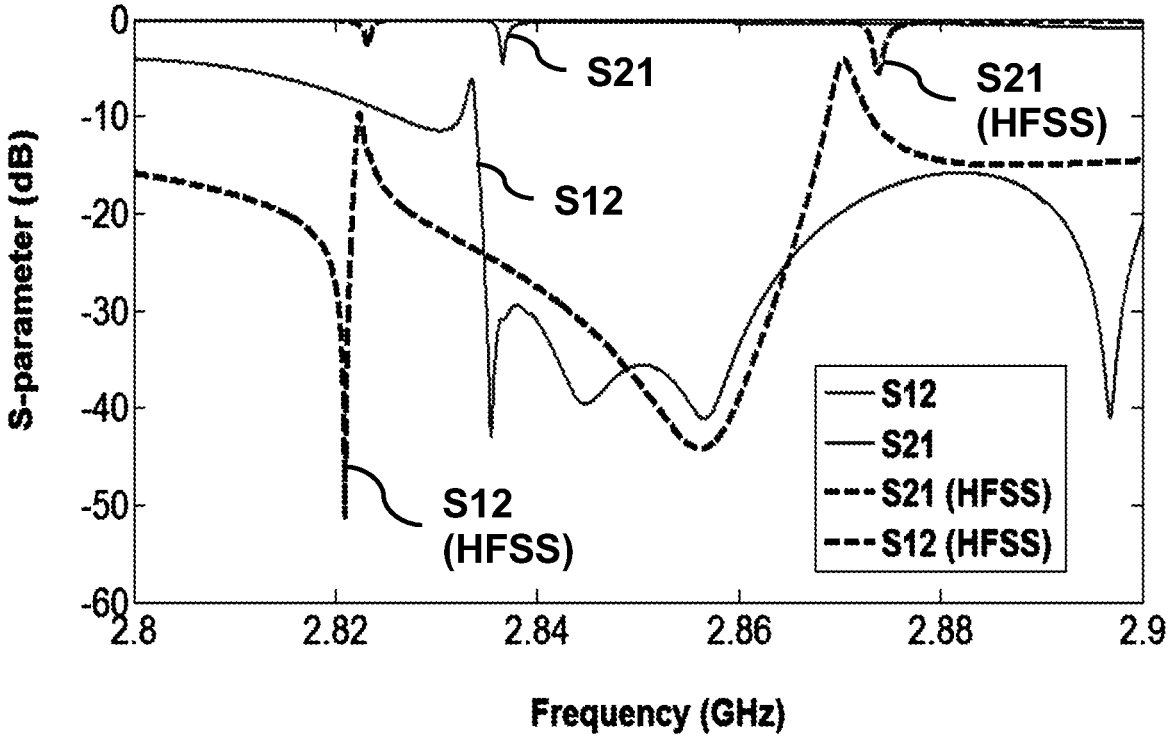
FIG. 11 shows the measured insertion loss of the FIG. 10C-D configuration as compared to the simulated values in HFSS with an applied magnetic field bias of 140 kA/m.

FIGS. 10A-D show the same test as performed in FIG. 9A-B but with the over-moded disk replacing the fundamental mode disk as the non-reciprocal element. FIG. 10A shows the cold test results for power incident at port: 1 1002 of the device as illustrated by the power flow diagram in FIG. 10C. Here power incident at port: 1 1002 is reflected off of the ferrite 1010 propagates back through waveguide 1012 and is transmitted directly to port: 2 1004. Due to a mismatch, caused by assembly error or material variability, there was a small about of power ($S_{41}$=−12 dB) that "leaked" through the ferrite 1010 and exited through port: 4 1008, which limited the measured insertion loss to greater than 0.3 dB. This type of power leakage caused by an asymmetric coupling of the two gyrotropic modes to the surrounding waveguide 1012 and is easily remedied in a production quality device. FIG. 10B shows the same measurement with power incident at port: 2 1004 instead of port: 1 1002 such that the ferrite 1010 observes the opposite sense polarization in the incoming wave through the waveguide 1012. The power is transmitted through the ferrite 1010 and exits port: 3 1006. Here, there were no tuning issues associated with this mode set and the insertion loss (0.13 dB), isolation (−50 dB) and return loss (−45 dB) matched expectations. FIG. 11 shows the measured insertion loss of the FIG. 10C-D configuration as compared to the simulated values in HFSS with an applied magnetic field bias of 140 kA/m.

Figure 12A:
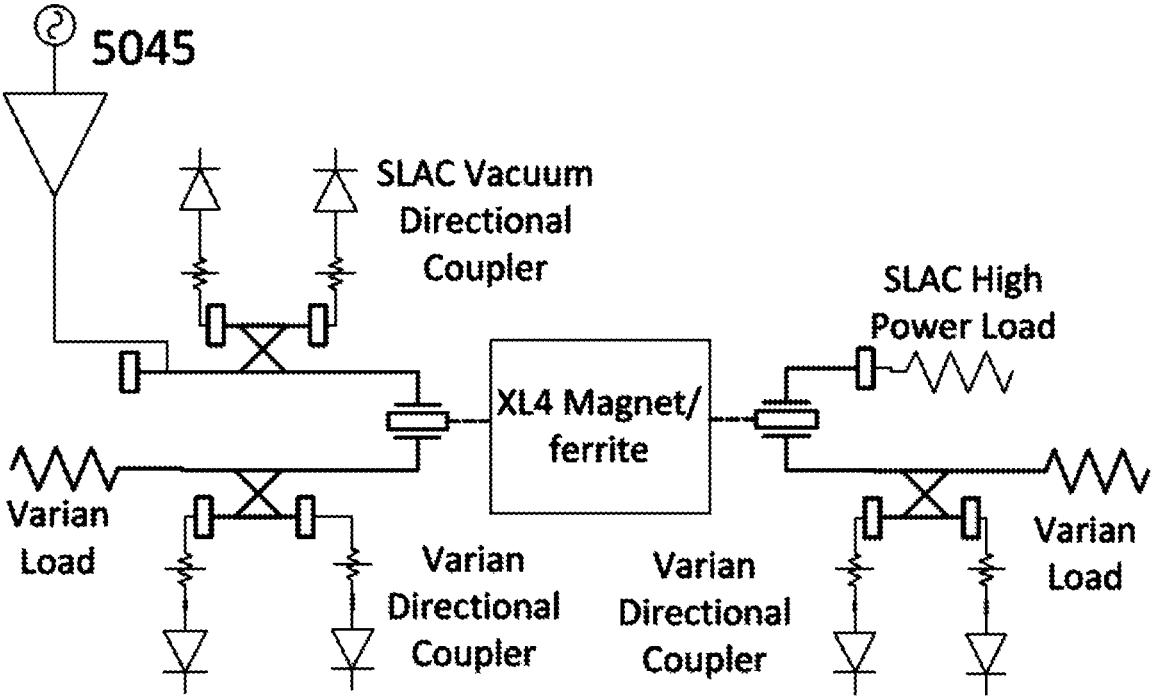
FIGS. 12A-C shows (FIG. 12A) a diagram of the high power experimental including RF source (50 MW, S-band) klystron, experimental configuration from FIG. 10C-D, directional couplers, and high power loads, (FIG. 12B) a plot of input power from the klystron, the power transmitted from port: 1 (input) to port: 2 (target), and power leaked through the ferrite to port: 4, and (FIG. 12C) a plot of the input power from port: 1 to target port: 4 with the polarity of the solenoid reversed.
Figure 12B:
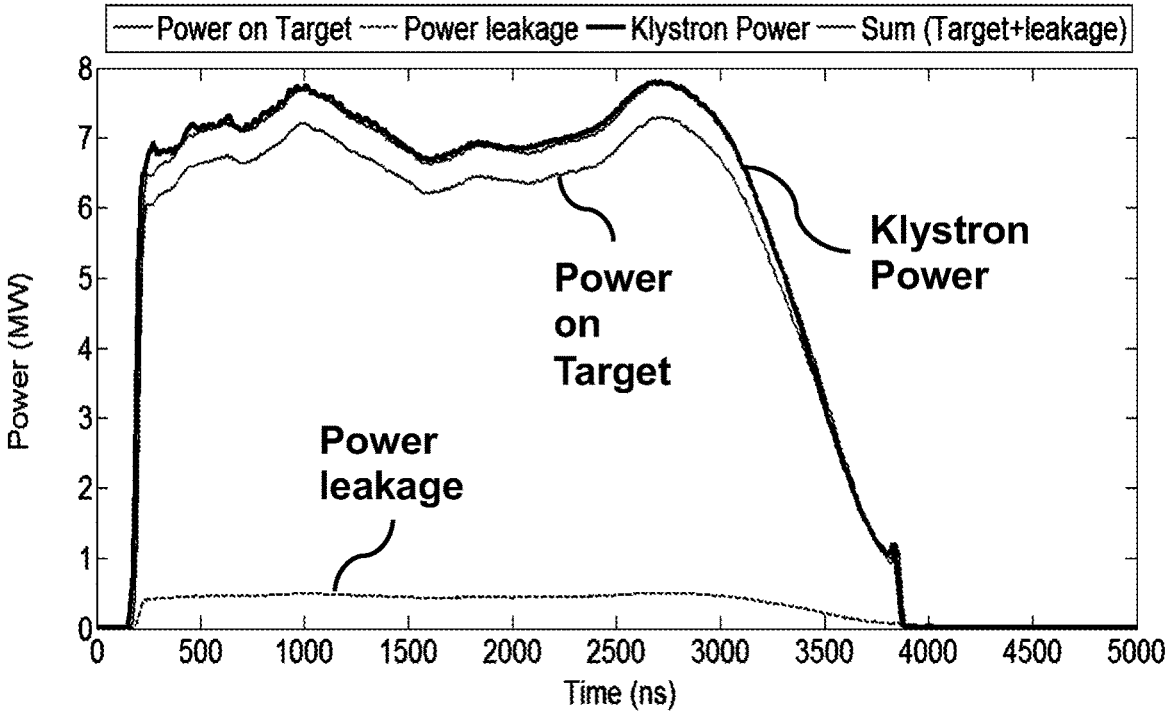
Figure 12C:
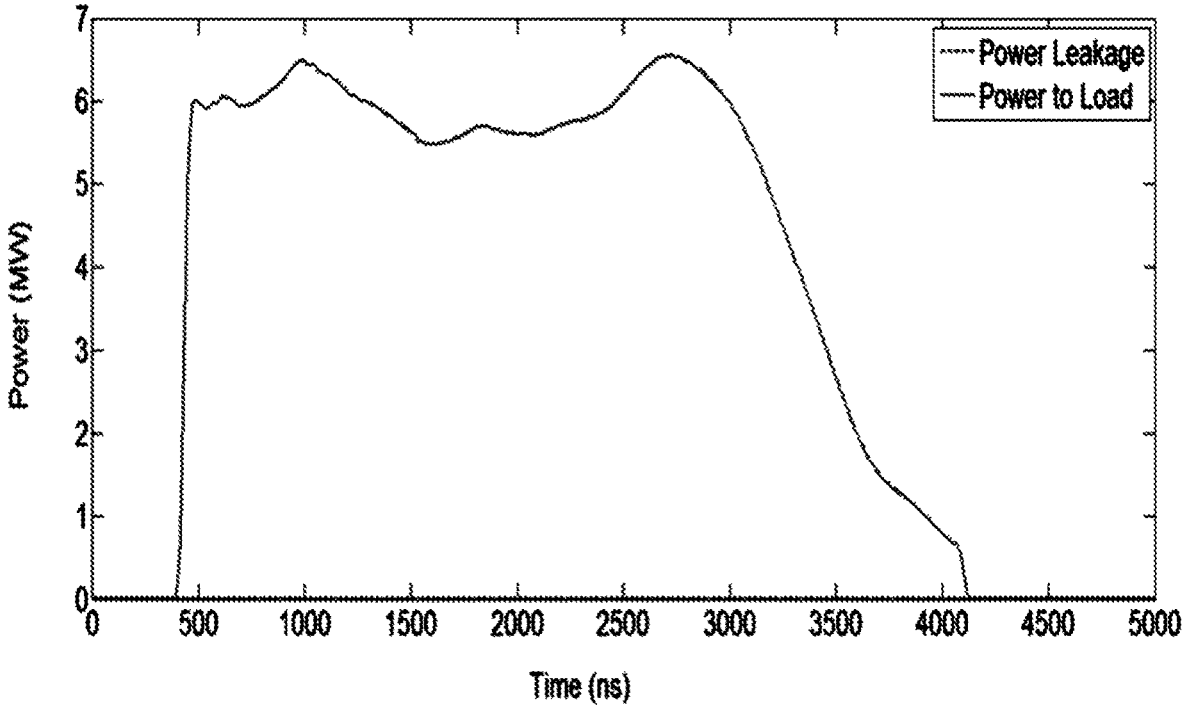

The power handling of the system, using the over-moded disk ferrite, was tested in a 30 psi dry nitrogen environment. The 4 port circulator as shown in the equipment diagram in FIG. 12A was connected, via port: 1, to a (50 MW) S-band 5045 klystron operating at 2.856 GHz. The remaining ports (2-4) were outfitted with high power directional couplers and loads to create a perfectly matched system for the klystron. One measurement was performed with the magnetic field in the +Z direction, similar to FIG. 10A,C at power levels up to 8 MW over 3.5 μs as shown in power vs time plot in FIG. 12B. The magnetic field polarity was then reversed (to the −Z direction) such that port: 1 could remain assembled to the klystron. The reversed magnet polarity forces the ferrite flip which polarization is reflected versus transmitted (as though the power were input from port: 2) to produce the time domain power profile illustrated in FIG. 12C which is in full agreement with the cold test data from FIGS. 10B,D.

All experiments were performed with large solenoid to simplify the bias network and produce a uniform field. Practical device will be much smaller and use permanent magnets to achieve the basic field.

FIGS. 13A-B shows such an example where a large 4-port circulator in FIG. 13A is reduced in size by placing a compact RF load 1300 over the cylindrical waveguide on the transmitting side of the ferrite 1302 to create a 2-port isolator with ports 1304, 1306. In this configuration, the large solenoid magnet used in the initial series of experiments is replaced with an annulus permanent magnet 1308 that is concentric with the ferrite as shown in FIG. 13B.

Embodiments of the invention can be applied or adapted in various ways, including devices having any shape and size ferrite that can produce this S-parameter matrix, any waveguide that supports this multi-mode field cancellation, a system which supports more than just two input modes, and any non-reciprocal media.

Figures 15A, 15B:
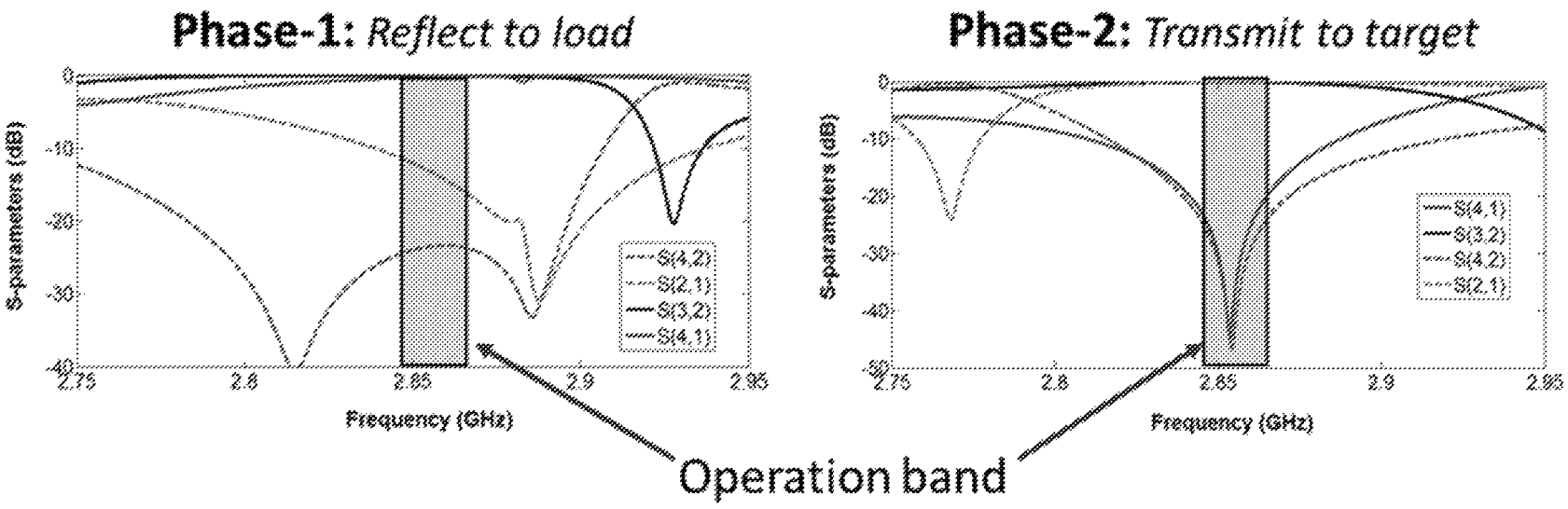
FIGS. 15A,B are graphs illustrating complete transmission or complete reflection of a given circularly polarized mode according to an embodiment of the invention.

Devices according to the principles of the present invention have a number of advantages, including Simplified bias circuit (Entire volume of NR-media can be close to the bias circuit; No pole pieces, Smaller magnets, Easy to cool); Highly sensitive network (Can be scaled to higher frequencies, Can operate at very high bias field (higher power handling), Can use lower magnetic saturation materials (lower loss). These advantages lend this type of annulus ferrite topology to a rapidly tunable system such as a switch or directional coupler. FIGS. 14A-D show such a concept wherein the ferrite 1400 is primary biased by an external permanent magnet array 1402, concentric with the ferrite. An additional, smaller, perturbation is applied to raise or lower the magnetic field in the ferrite via a single current carrying loop 1404. Since the ferrite is biased well above saturation and most "hard" permanent magnets have a permeability close to unity, this loop can have an inductance less than 100 nH. Provided the proper circuit topology to rapidly pass current through this loop, the magnetic bias field and hence the material properties of the annulus ferrite can be rapidly adjusted to support complete transmission or complete reflection of a given circularly polarized mode as illustrated in FIGS. 14C,D and FIGS. 15A,B. Numerical models suggest that such an assembly could be used as an RF switch capable of switching 10's MW in under 10 ns. More complex embodiments of this concept could be employed to produce the high power tunable distribution network drawn in FIG. 15D. In such as embodiment, multiple assemblies as shown in FIG. 14A are assembled in series via their standard waveguide inputs and each non-reciprocal element is tuned somewhere between complete reflection and complete transmission as shown by the power flow diagram in FIG. 15C. Reflected power would propagate out of one device and into another while any power transmitted would be directed to the desired target.

Additionally, the non-reciprocal elements (ferrites) themselves can be placed in series along the source and target waveguide as shown in FIG. 16A. This produces multiple points of reflection along the same transmission line and can be tuned to provide the proper scattering matrix described above while also reducing the demand on the bias field and anisotropy of the non-reciprocal media. One application of such an array would be to use very low loss materials with line widths less than 20 Oe and magnetic saturations less than 1000 G to produce high frequency circuits. FIG. 16B illustrates the transmission bandwidth of the circuit depicted in FIG. 16A operating at a center frequency of 285 GHz while maintaining an insertion loss of 0.2 dB.

In conclusion, the invention provides a two port, 4 (or more) mode, non-reciprocal network that couples to a waveguide which supports the existence of multiple input/output modes (typically polarized), which allows for each, linearly polarized, input mode to couple equally into all supported waveguide modes moving forward and backward, and which admits an input signal having two or more, out of phase, modes in waveguide. It is adapted to reflect or transmit signal(s) depending on direction of magnetic field bias and difference in phase. It achieves proper discrimination of input signals by altering the boundary conditions of the NR media.

The non-reciprocal network may be realized using contiguous thin annulus rings or films around the perimeter of the waveguide, ferrite geometry that either completely or partially fills the waveguide, or arrays of ferrite around the perimeter of the waveguide.

The non-reciprocal network supports a magnetic bias circuit that does not require the use of pole pieces, and can be a bias circuit that does not use pole pieces that is driven with electrical current (solenoid) or that does not use pole pieces where the magnetic field is supplied via a permanent.

The non-reciprocal network supports the simultaneous excitation of multiple higher order modes in the NR-media. An over-moded network allows for the exploitation of a number of hybrid electric modes to distribute Poynting flux and enhance power handling. The over-moded network also supports the excitation of dissimilar combinations of modes by input polarization versus the other.

In some embodiments, the non-reciprocal network targets TE dominated gyrotropic modes for one input polarization and TM dominated modes for the other. The network may also shield electromagnetic triple points

The invention claimed is:

1. A microwave non-reciprocal network device comprising:

a source waveguide capable of supporting multiple input/output modes;

a target waveguide capable of supporting multiple input/output modes;

an inline non-reciprocal network connected to the source waveguide and the target waveguide and comprising a non-reciprocal media element;

wherein the inline non-reciprocal network is tuned such that each of multiple linearly polarized input modes couples equally into supported modes of the source and target waveguide moving forward and backward, wherein the inline non-reciprocal network is adapted to cancel the forward or backward waves depending on a relative phase difference between two or more orthogonal input signals to the network.

2. The microwave non-reciprocal network device of claim 1 wherein the source waveguide and target waveguide are connected to passive hybrid mode converters capable of directing power to standard waveguide based on relative phase.

3. The microwave non-reciprocal network device of claim 1 wherein the non-reciprocal media element acts to produce non-reciprocal directivity in a two port isolator configuration or a four port circulator configuration.

4. The microwave non-reciprocal network device of claim 1 wherein the non-reciprocal media element at least partially fills a region of the inline non-reciprocal network that supports at least half of a guided wavelength.

5. The microwave non-reciprocal network device of claim 1 wherein the non-reciprocal media element is a cylindrical disk, rectangular plate, cylindrical annulus, or rectangular annulus.

6. The microwave non-reciprocal network device of claim 1 wherein a housing of the non-reciprocal media element has a circular, rectangular, elliptical or coaxial cross section.

7. The microwave non-reciprocal network device of claim 1 wherein the source waveguide has a circular, rectangular, elliptical, or coaxial cross section.

8. The microwave non-reciprocal network device of claim 1 wherein the target waveguide has a circular, rectangular, or elliptical cross section.

9. The microwave non-reciprocal network device of claim 1 wherein the non-reciprocal media element is biased by a permanent magnet and/or solenoid with or without pole pieces.

10. The microwave non-reciprocal network device of claim 1 wherein the inline non-reciprocal network comprises multiple non-reciprocal elements placed in series to produce a desired directivity.

11. The microwave non-reciprocal network device of claim 1 wherein the non-reciprocal media element is biased above or below a gyromagnetic resonance to achieve directivity.

12. The microwave non-reciprocal network device of claim 1 wherein the non-reciprocal media element is biased at gyromagnetic resonance to achieve RF absorption.

13. The microwave non-reciprocal network device of claim 1 wherein the non-reciprocal element is adapted to function also as a physical barrier or mode converter.

14. The microwave non-reciprocal network device of claim 1 wherein the non-reciprocal element is one contiguous piece or multiple connected or disconnected pieces.

* * * * *